US005154500A

United States Patent [19]

Chang

[11] Patent Number: 5,154,500

[45] Date of Patent: Oct. 13, 1992

[54] COLLAPSIBLE COMPARTMENT-FORMING INSERT SYSTEM FOR STORAGE LOCKERS

[76] Inventor: Yao-Shien Chang, 15305 Watergate Rd., Silver Spring, Md. 20905

[21] Appl. No.: 779,304

[22] Filed: Oct. 18, 1991

[51] Int. Cl.[5] ..... A47B 43/00

[52] U.S. Cl. ..... 312/258

[58] Field of Search ..... 312/250, 297, 257.1; 160/135, 229.1; 52/71

[56] References Cited

U.S. PATENT DOCUMENTS 1,216,250 2/1917 Bittle .
3,662,807 5/1972 Miller ..... 160/135
4,296,524 10/1981 Horholt et al, ..... 312/258 X
4,500,148 2/1985 Peterson ..... 108/107
4,818,044 4/1989 Dobry ..... 312/257.1

*Primary Examiner*—Joseph Falk

[57] ABSTRACT

A collapsible compartment-forming and shelving insert system for use in a storage locker includes a plurality of flat panels of predetermined dimensions with respect to dimensions of the interior of the locker. The panels are normally positioned in closely stacked relationship with each other for storage or transport before insertion into the locker. Hinges are connected to the panels for enabling the panels to be inserted into and expanded to a zigzag configuration within the locker to form a plurality of vertically aligned storage compartments.

19 Claims, 1 Drawing Sheet

COLLAPSIBLE COMPARTMENT-FORMING INSERT SYSTEM FOR STORAGE LOCKERS

This invention relates to a storage compartment and shelving system and more particularly to a collapsible compartment-forming insert system for use in storage lockers.

Lockers used by students and athletes for storing books, folders, notebooks, athletic equipment, gym clothes, shoes, etc. typically poorly use the space available within the locker. As a result, items stored within the locker are often unnecessarily damaged, and items sought are frequently to be found at the bottom of the locker in a large heap of other items being stored within the locker. It is often necessary to search through the large number of items stacked at the bottom of the locker before finding the item desired, and items stacked in a heap at the bottom of the locker are often damaged.

It is, therefore, an object of the present invention to provide a collapsible compartment-forming insert system for use in storage lockers.

Another object is to provide such a system which permits the orderly storage of various items within the locker.

A further object of the invention is the provision of such a system which allows for quick and easy retrieval of items from the storage locker.

Still another object is to provide such a system which is collapsible and portable and which is easy to insert and to remove from the storage locker.

Yet another object of the present invention is the provision of such a system which allows items to be stored in an orderly manner within the storage locker and without causing damage to the items being stored.

A still further object is to provide such a system which includes replacement panels for accommodating the system to lockers of different sizes.

Another object is to provide such a system which is compact for easy storage when not in use.

Still another object is to provide such a system which is inexpensive to manufacture and easy to use.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a collapsible compartment-forming insert system for use in a storage locker, the system comprising: a first plurality of substantially flat panels of predetermined thickness, of first predetermined dimensions with respect to dimensions of the interior of the storage locker, and normally positioned in stacked relationship with each other for insertion into the locker; and hinge means connected in operative relationship with the panels for enabling the panels to be inserted into and positioned in zigzag configuration within the locker.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

Figure 1:
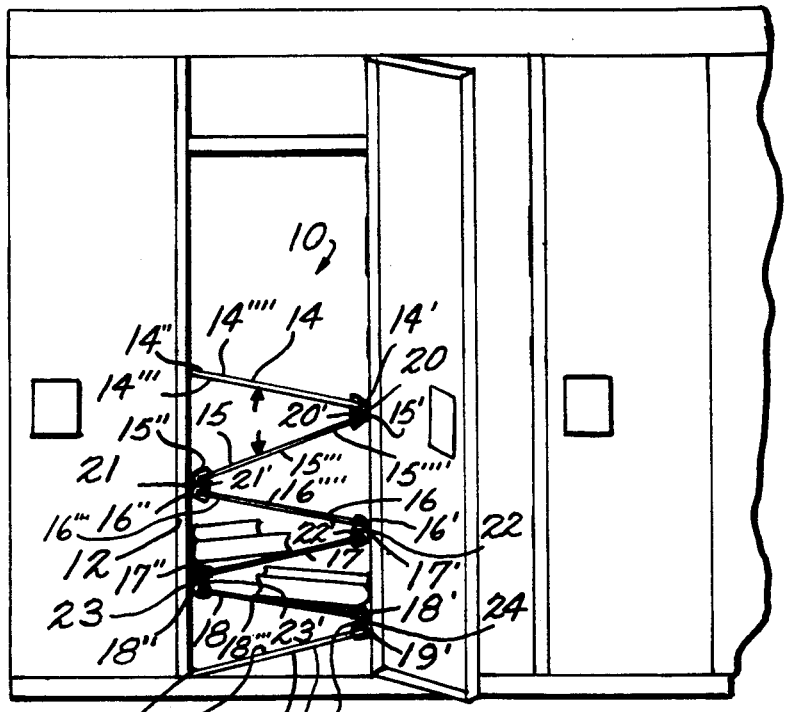
FIG. 1 is a front elevation view showing the insert system for use inside a conventional storage locker.
Figure 2:
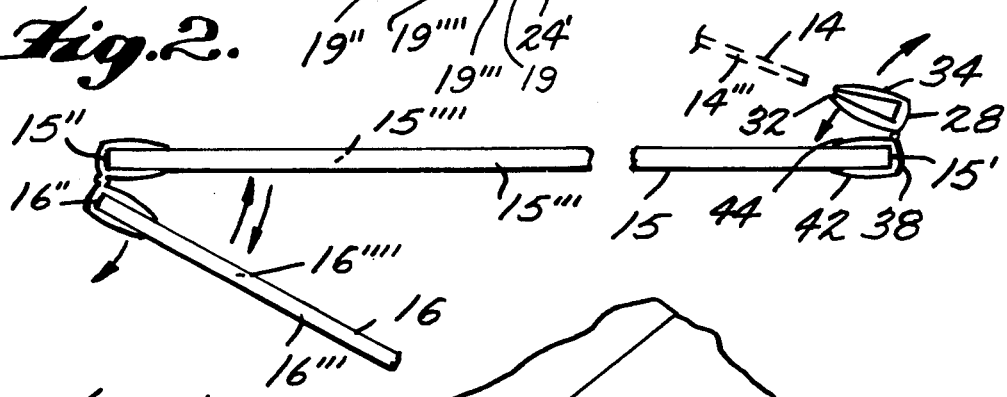
FIG. 2 is a fragmentary front elevation view showing a portion of the insert system in more detail.
Figure 3:
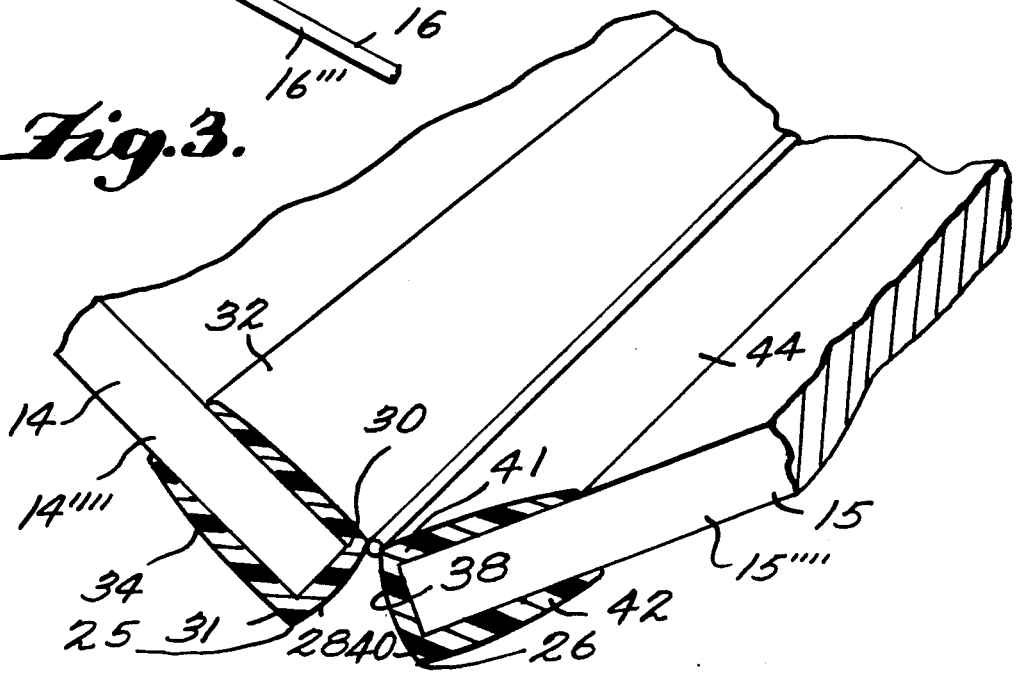
FIG. 3 is a fragmentary perspective view of a portion of the insert system and illustrating a hinge in more detail.

With reference now to the drawings, wherein like reference characters designate like or corresponding parts throughout the several views, there is shown a collapsible compartment-forming insert system 10 for use in a conventional storage locker 12. System 10 comprises a first plurality 14–19 of substantially flat panels of predetermined thickness. Although six panels are shown, it should be understood that a greater or a lesser number of panels could be used. Each of panels 14–19 has predetermined dimensions with respect to the dimensions of the interior of storage locker 12, and panels 14–19 are normally positioned in closely stacked relationship, one on top of the other, for storage or transport before insertion into locker 12.

Hinge means 20–24 are connected in operative relationship with panels 14–19 for enabling the panels to be inserted into and positioned in zigzag configuration within locker 12. Each of panels 14–19 defines a first edge 14'–19', respectively, and a second opposed edge 14''–19'', respectively. Panels 14–19 are normally positioned in closely stacked relationship with first edges 14'–19' in substantial alignment with each other and with second edges 14''–19'' in substantial alignment with each other. The first and second edges of each panel are preferably substantially parallel to each other, and the stacked panels are compact and easily stored or transported in the stacked position.

Hinge means 20–24 include a plurality of hinges 20'–24'. A first one 20' of the hinges is removably connected along first edges 14', 15', respectively, of first or top panel 14 in the panel stack and second panel 15 located immediately beneath top panel 14 in the stacked relationship. A second one 21' of the hinges is similarly removably connected along second edges 15'', 16'' of panels 15, 16, respectively. Additional hinges 22', 23' and 24' are similarly connected to edges of panels 16–19, as best shown in FIG. 1.

Each of hinges 20'–24' comprises first clamping means 25 for removably grasping and holding a first panel, such as 14. Each of hinges 20'–24' further includes second clamping means 26 movably attached to first clamping means 25 for removably grasping and holding a second of the panels, such as 15.

First clamping means 25 preferably includes a first elongated, flexible spine element 28 which defines first and second opposed and substantially parallel longitudinal edges 30, 31, respectively. A first flexible clamping element 32 is connected to and projects from edge 30, and a second flexible clamping element 34 is connected to and projects from edge 31 in opposed relationship with clamping element 32 so that first panel 14, for example, can be slidably inserted and removably held between clamping elements 32, 34.

Second clamping means 26 comprises a second elongated, flexible spine element 38 which defines first and second opposed and substantially parallel longitudinal edges 40, 41, respectively. First edge 30 of spine element 28 is movably or flexibly attached to second edge 41 of spine element 38 to permit hinge-like movement between clamping means 24, 26.

A third flexible clamping element 42 is connected to and projects from first edge 40 of spine element 38, and a fourth flexible clamping element 44 is connected to and projects from second edge 41 of spine element 38 so that second panel 15, for example, can be slidably inserted and removably held between clamping elements 42, 44.

In order to ensure a tight fit between the panels and clamping elements, the distance between edges 30, 31 of spine element 28 and the distance between edges 40, 41 of spine element 38 are each substantially equal to the thickness of each of panels 14–19.

Each of hinges 20'–24' is preferably comprised of injection molded or extruded plastic. Although not illustrated, various different types of hinge arrangements could be used, such as rings or spiral binding hinges.

Each of panels 14–19 is preferably substantially rectangular in shape, and each of the panels defines a first lengthwise edge 14'''–19''', respectively, and a second opposed substantially parallel lengthwise edge 14''''–19'''', respectively. Opposed edges 14'–19' and 14''–19'' define the width of each panel 14–19, respectively.

In accordance with the invention, lengthwise edges 14'''–19''' and 14''''–19'''' of each panel 14–19 is greater in length than the interior width of storage locker 12 so that panels 14–19 can be expanded within the locker and held in position and supported by the walls of the locker in zigzag configuration.

Experimentation has determined that the greatest efficiency and maximum storage space is achieved if the angle between each of panels 14–19 when the panels are in a zigzag configuration within locker 12 is when the angle between each adjacent panel is approximately seventy degrees. Accordingly, it is preferred that lengthwise edges 14'''–19''' and 14''''– 19'''' of panels 14–19 are each substantially equal to the interior width of storage locker 12 divided by the cosign of thirty-five degrees to provide the greatest efficiency and maximum storage space.

Each of clamping means 25, 26 preferably defines an open-ended, elongated tubular element having a substantially U-shaped cross-section, and each of clamping means 25, 26 is preferably formed so that clamping elements 32, 34 and 42, 44 are positioned with free ends of each of the clamping elements in close proximity to each other. This will ensure that clamping elements 32, 34 and 42, 44 tightly grasp and hold the panels in position.

This invention contemplates the use of panels 14–19 of various sizes to accommodate lockers of different sizes. The width of each panel along edges 14'–19' and 14''–19'' must also be less than the front-to-rear depth dimension of the storage locker.

In use, panels 14–19 are positioned within respective clamping means 25, 26 by inserting each panel at an open end of clamping means 25 or 26 and by sliding the panel lengthwise along the tubular element formed by the clamping means 25 or 26 until the panel is centered in position along clamping means 25 or 26. Edge 14' of panel 14, for example, is positioned in contact with spine element 28 of clamping means 25, and the dimensions of spine element 28 are such that panel 14, for example, tightly fits against spine element 28 while panel 14 is tightly grasped and frictionally held in position by clamping elements 32, 34. The remaining panels are similarly inserted into the hinges, and hinged panels 14–19 can then be neatly stacked, one on top of the other, for storage or transport.

When system 10 is to be inserted into locker 12, panels 14–19 are simply lifted and allowed to be rotated about hinges 20'–24' so that panels 14–19 are expanded to a zigzag or substantially in-line configuration. The expanded panels are then inserted into locker 12 so that edges 14'–19', 14''–19'' and hinges 20'–24' are positioned substantially against the interior side walls of locker 12. The locker's side walls then hold panels 14–19 in fixed position to form a series of vertically aligned substantially triangular-shaped storage compartments within locker 12.

When system 10 is to be removed from locker 12, expanded panels 14–19 are simply removed from the interior of the locker, and panels 14–19 can then be collapsed about hinges 20'–24' to reform panels 14–19 in a closely stacked configuration for storage or transport.

Various sizes of panels 14–19 can be provided for lockers of different sizes. It is also possible that panels 14–19 could be of other than rectangular shape, but the rectangular shape is preferred. Panels 14–19 can be made from plastic, particle board, cardboard, metal or any other suitable material.

This invention provides a simple and effective compartment-forming insert system for use in storage lockers for maximizing the usable space within the locker.

The invention in its broader aspects is not limited to the specific details shown and described, and departures may be made from such details without departing from the principles of the invention and without sacrificing its chief advantages.

What is claimed is:

1. A collapsible compartment-forming insert system for use and in combination with a storage locker, said combination comprising:

a storage locker having interior width and depth dimensions;

a plurality of substantially flat panels of predetermined thickness and of first predetermined length and width dimensions with respect to said interior width and depth dimensions, respectively, of said locker; and hinge means connected in operative relationship with said panels for enabling said panels to be normally positioned in stacked relationship with each other before insertion into said locker and for enabling said panels to be inserted into and positioned in zigzag configuration within said locker to form a plurality of vertically aligned storage compartments within said locker.

2. A combination as in claim 1 wherein each of said panels defines first and second opposed edges.

3. A combination as in claim 2 wherein said panels are positioned in said stacked relationship with said first edges in substantial alignment with each other and with said second edges in substantial alignment with each other.

4. A combination as in claim 3 wherein said first and second edges of each said panel are substantially parallel to each other.

5. A combination as in claim 4 wherein said hinge means include a plurality of hinges.

6. A combination as in claim 5 wherein a first of said hinges is removably connected along said first edges of a first, top panel in said stacked relationship and a second said panel located immediately beneath said top panel in said stacked relationship.

7. A combination as in claim 6 wherein a second of said hinges is removably connected along said second edges of said second panel and a third said panel located immediately beneath said second panel in said stacked relationship.

8. A combination as in claim 7 wherein each of said hinges comprises:

first clamping means for removably grasping and holding a first said panel; and second clamping means movably attached to said first clamping means for removably grasping and holding a second of said panels.

9. A combination as in claim 8 wherein said first clamping means comprises:

a first elongated, flexible spine element defining first and second opposed and substantially parallel longitudinal edges;

a first flexible clamping element connected to and projecting from said first edge; and a second flexible clamping element connected to and projecting from said second edge in opposed relationship with said first clamping element, whereby said first panel can be slidably inserted and removably held between said clamping elements.

10. A combination as in claim 9 wherein said second clamping means comprises:

a second elongated, flexible spine element defining first and second opposed and substantially parallel longitudinal edges, said first edge of said first spine element movably attached to said second edge of said second spine element;

a third flexible clamping element connected to and projecting from said first edge of said second spine element; and a fourth flexible clamping element connected to and projecting from said second edge of said second spine element, whereby said second panel can be slidably inserted and removably held between said third and fourth clamping elements.

11. A combination as in claim 10 wherein the distance between said first and second edges of said first spine element is substantially equal to the thickness of said first panel.

12. A combination as in claim 11 wherein the distance between said first and second edges of said second spine element is substantially equal to the thickness of said second panel.

13. A combination as in claim 12 wherein each of said plurality of hinges is comprised of flexible plastic.

14. A combination as in claim 13 wherein each of said panels is substantially rectangular in shape having two opposed substantially parallel lengthwise edges and said first and second opposed edges defining the width of said panel.

15. A combination as in claim 14 wherein said lengthwise edges of each said panel are greater in length than the interior width of said storage locker.

16. A combination as in claim 15 wherein said lengthwise edges of each said panel are each substantially equal to the interior width of said storage locker divided by the cosign of thirty-five degrees to provide greatest efficiency and maximum storage space.

17. A combination as in claim 16 wherein said width of each said panel is less than the front-to-rear depth of said storage locker.

18. A combination as in claim 10 wherein each of said first and second clamping means defines an open-ended, elongated tubular element having a substantially U-shaped cross-section.

19. A combination as in claim 1 including a second plurality of substantially flat panels of second predetermined length and width dimensions for substitution in place of said first plurality of panels to accommodate another storage locker having different interior width and depth dimensions.

* * * * *